US008075350B2

(12) United States Patent
Heggemann et al.

(10) Patent No.: US 8,075,350 B2
(45) Date of Patent: Dec. 13, 2011

(54) CONNECTOR APPARATUS WITH CODE MEANS, AND METHOD OF ASSEMBLING THE SAME

(75) Inventors: Christian Heggemann, Detmold (DE); Jens Oesterhaus, Detmold (DE); Matthias Boensch, Bielefeld (DE); Matthias Niggemann, Doerentrup (DE); Michael Lenschen, Detmold (DE); Stephan Fehling, Lage (DE); Torsten Diekmann, Leopoldshoehe (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 316 days.

(21) Appl. No.: 12/320,856

(22) Filed: Feb. 6, 2009

(65) Prior Publication Data

US 2009/0209140 A1 Aug. 20, 2009

(30) Foreign Application Priority Data

Feb. 14, 2008 (DE) ..... 10 2008 009 350

(51) Int. Cl.
*H01R 13/64* (2006.01)

(52) U.S. Cl. ..... 439/680

(58) Field of Classification Search ..... 439/680, 439/681, 701, 157, 347, 573, 472, 532, 939, 439/491, 903

See application file for complete search history.

(56) References Cited

U.S. PATENT DOCUMENTS

| | | | | |
|---|---|---|---|---|
| 3,491,330 | A | 1/1970 | Barnhart | |
| 4,820,204 | A * | 4/1989 | Batty | 439/681 |
| 5,254,019 | A * | 10/1993 | Noschese | 439/681 |
| 5,273,462 | A | 12/1993 | Huser et al. | |
| 6,814,625 | B2 * | 11/2004 | Richmond et al. | 439/681 |

FOREIGN PATENT DOCUMENTS

| | | | |
|---|---|---|---|
| DE | 202005002179 | U1 | 7/2006 |
| EP | 0033286 | A2 | 8/1981 |
| EP | 1 119 229 | A1 | 7/2001 |
| EP | 1119229 | A1 | 7/2001 |
| WO | 00/62380 | A1 | 10/2000 |

* cited by examiner

*Primary Examiner* — Edwin A. Leon

(74) *Attorney, Agent, or Firm* — Lawrence E. Laubscher, Sr.; Lawrence E. Laubscher, Jr.

(57) ABSTRACT

A plug connector and a method of coding of same is characterized by first and second coding elements that are premountable as a unit on at least one of a pair of plug connector components. The other plug connector component is configured so that when the connector components are initially connected together in an axial direction, one of the coding elements is connected with one of the components and the other coding element is connected with the other component. When the components are separated axially, the respective coding elements are separated so that each are retained on the component with which it was originally connected.

16 Claims, 21 Drawing Sheets

Fig. 4A
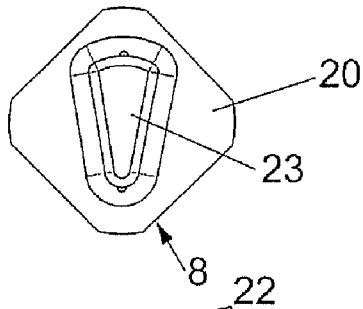
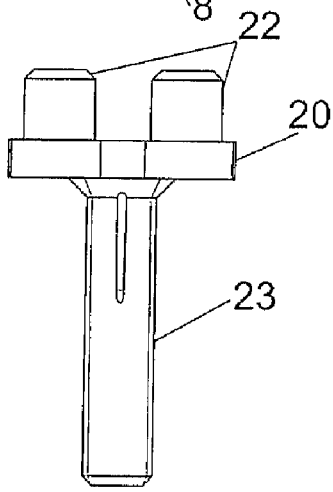
Fig. 4B
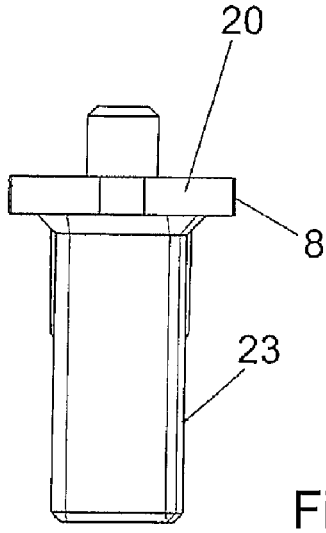
Fig. 4C
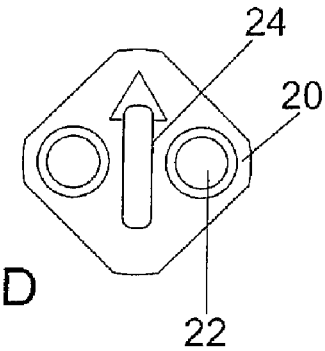
Fig. 4D
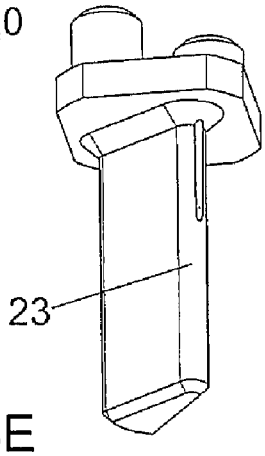
Fig. 4E
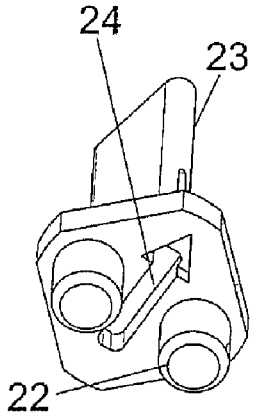
Fig. 4F Fig. 5A
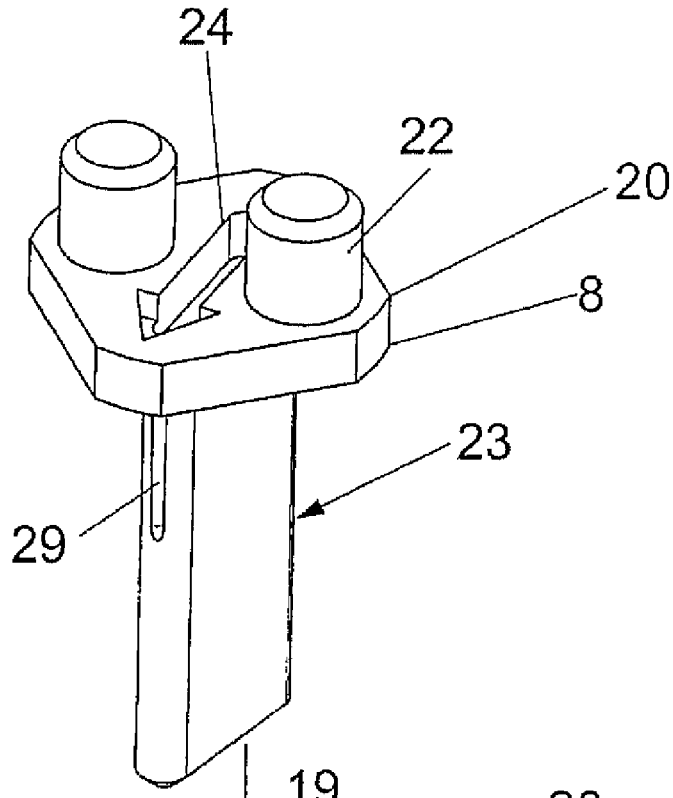
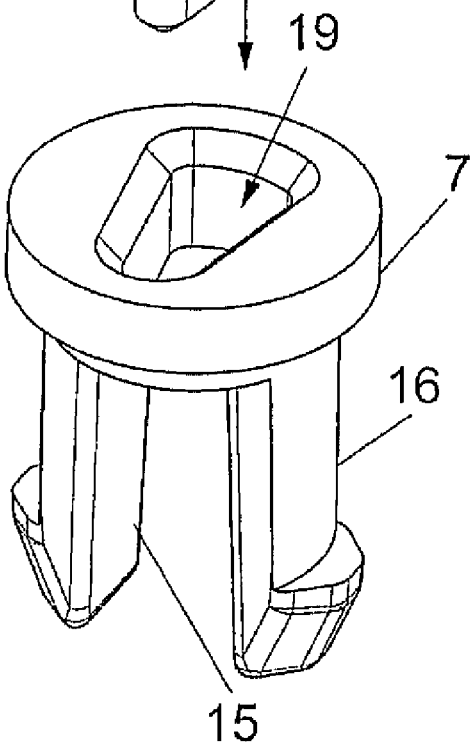
Fig. 5B
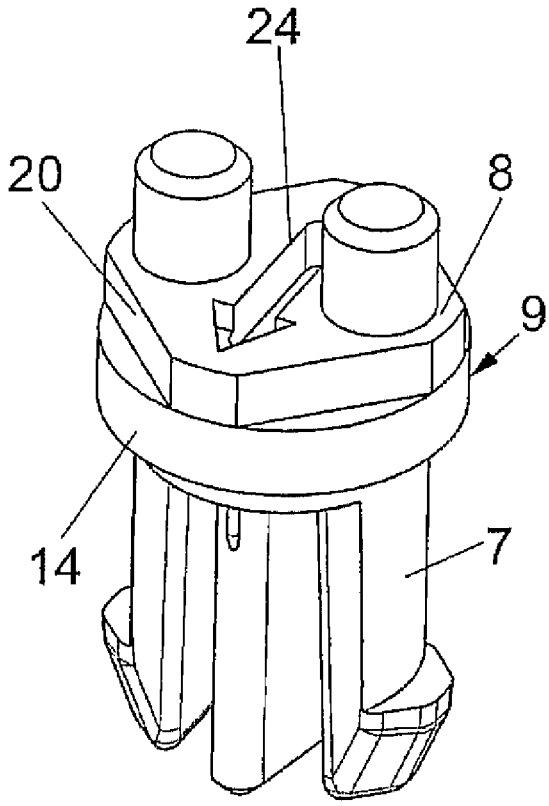
Fig. 5C Fig. 8C
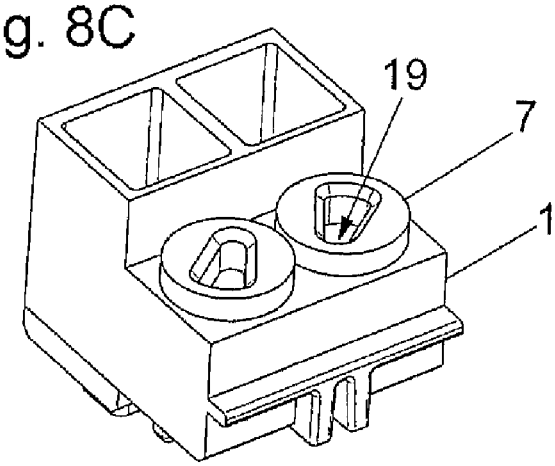
Fig. 8D
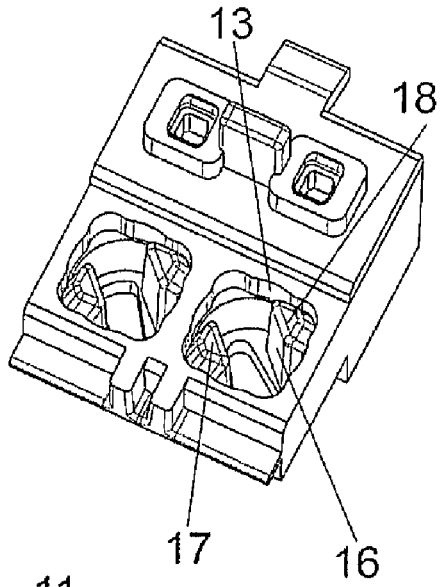
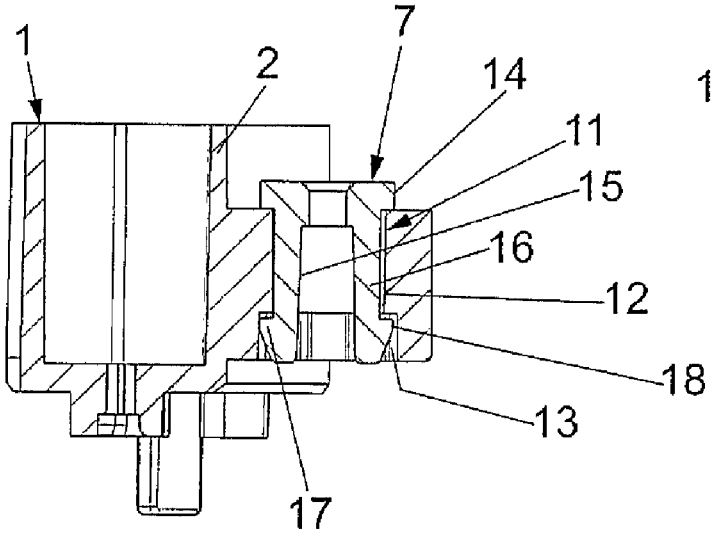
Fig. 8B
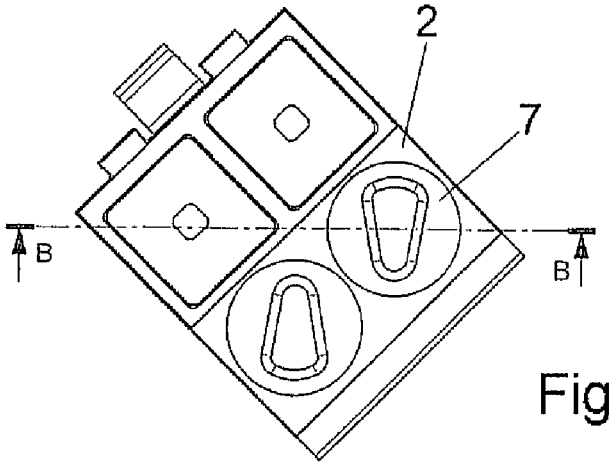
Fig. 8A Fig. 12A
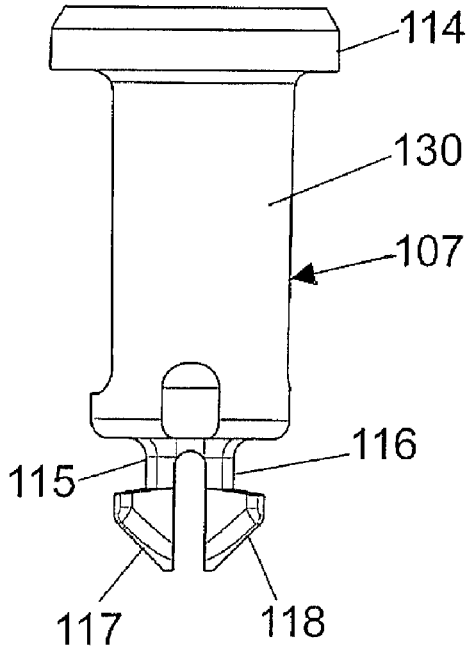
Fig. 12B
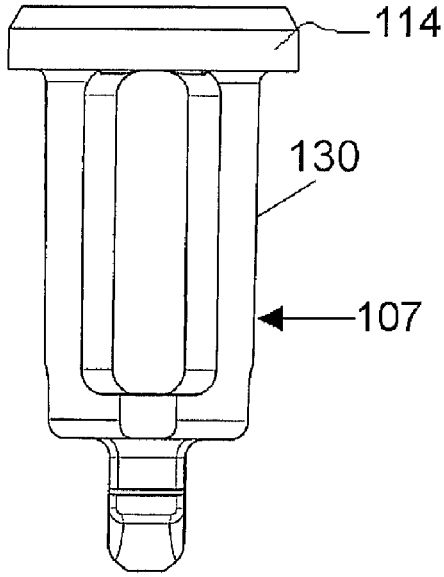
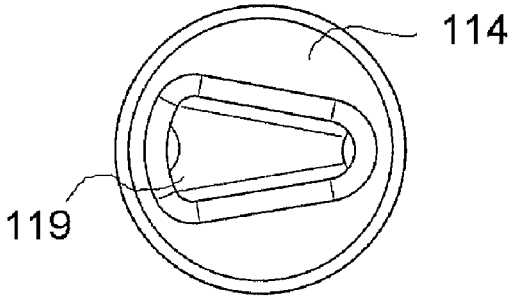
Fig. 12C
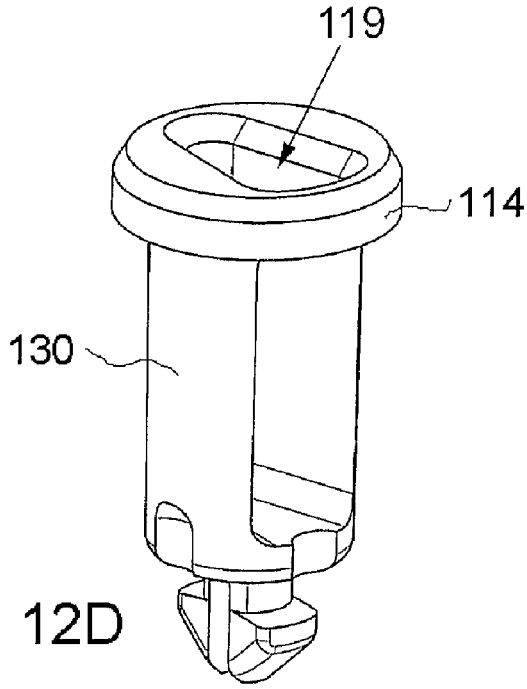
Fig. 12D Fig. 13A
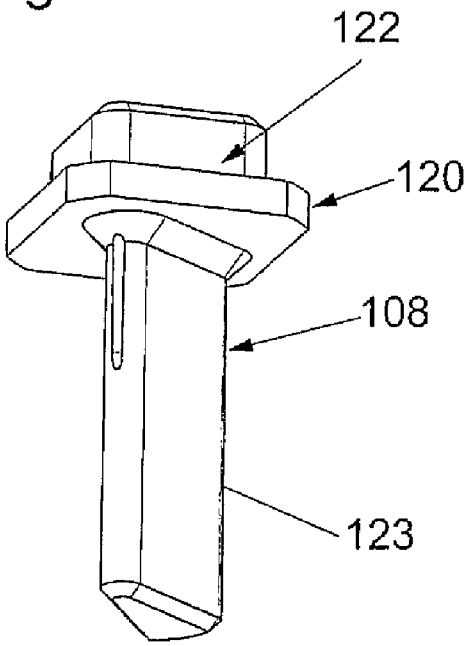
Fig. 13B
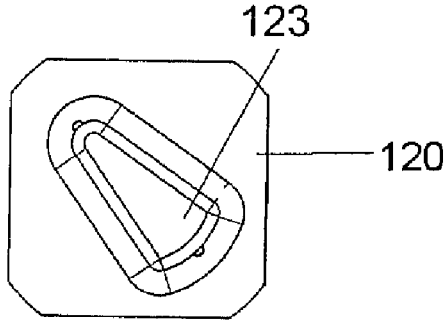
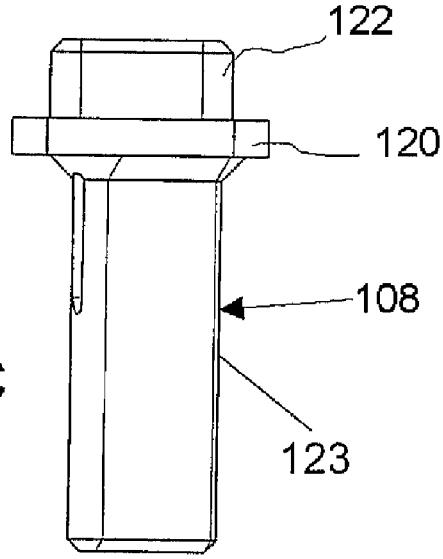
Fig. 13C
Fig. 13D
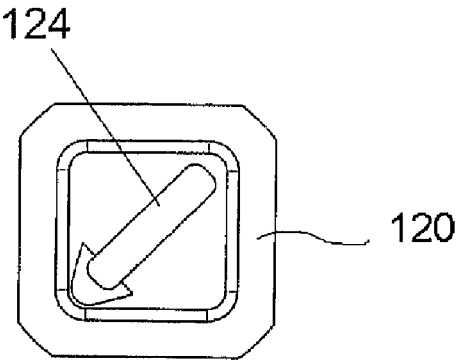

Fig. 15B
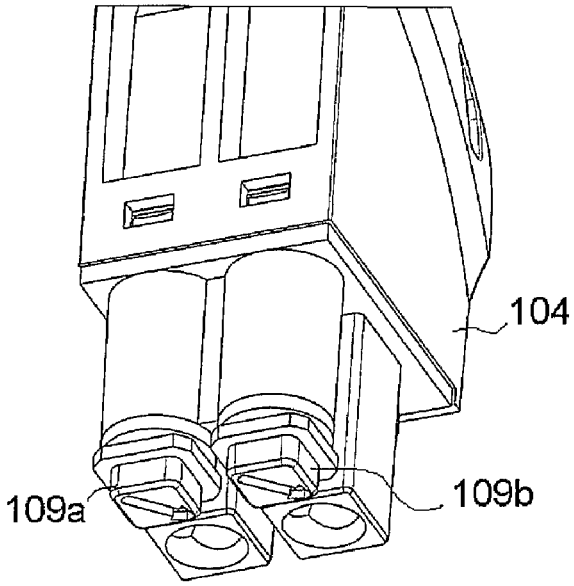
Fig. 15C
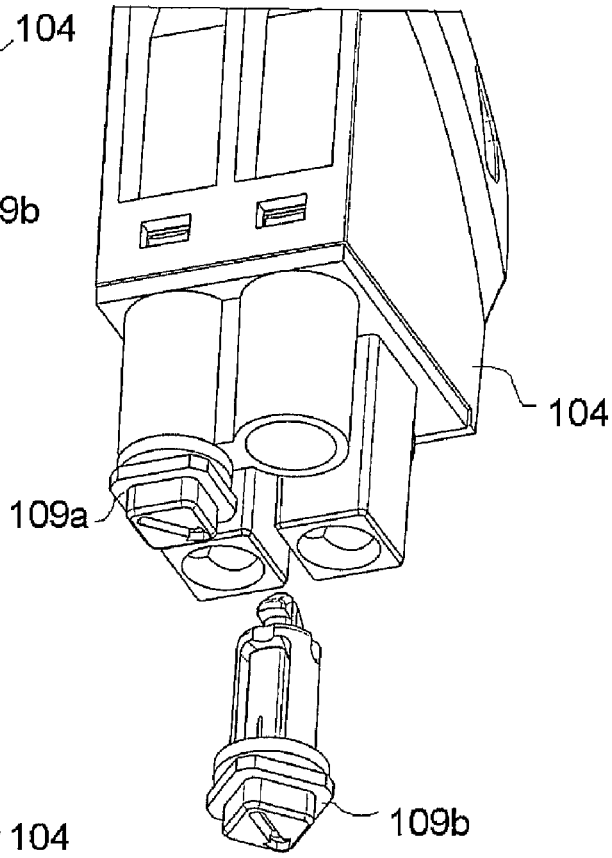
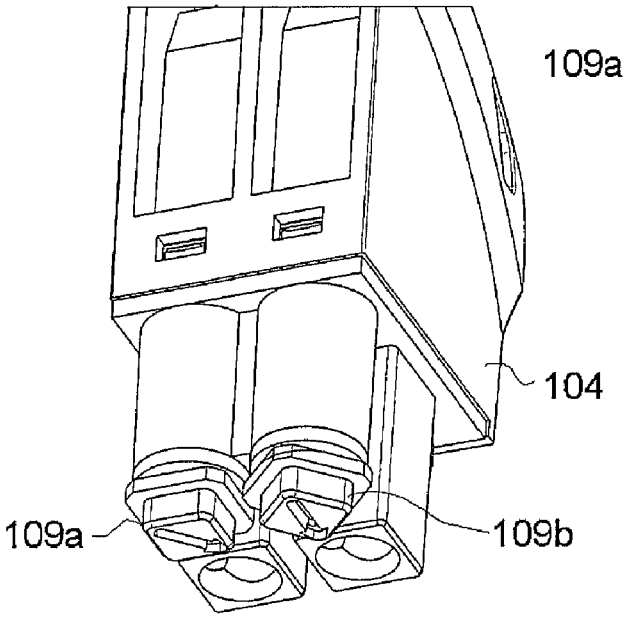
Fig. 15A

Fig. 17B
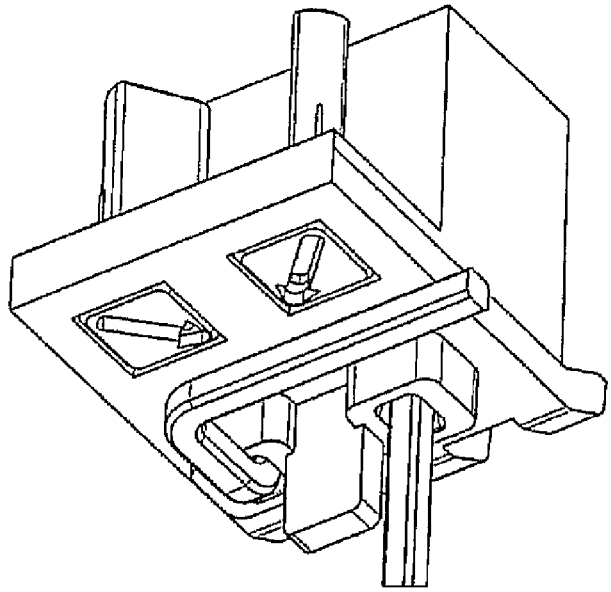
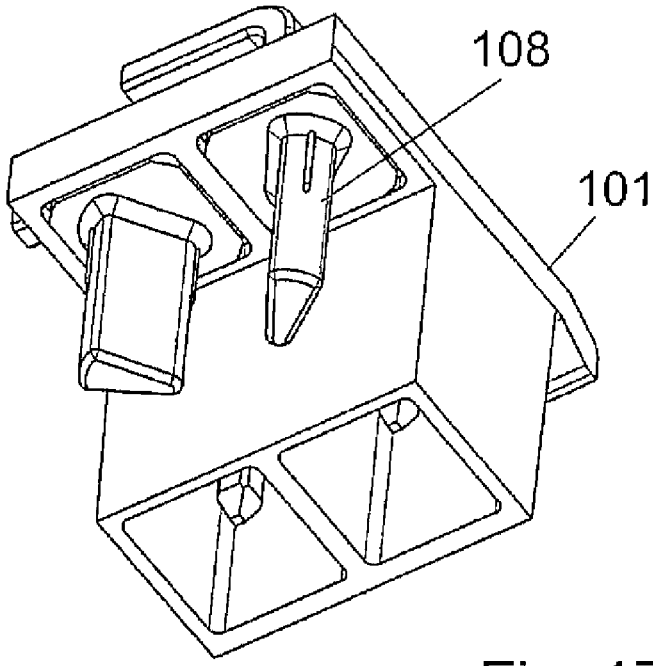
Fig. 17A

CONNECTOR APPARATUS WITH CODE MEANS, AND METHOD OF ASSEMBLING THE SAME

REFERENCE TO RELATED APPLICATIONS

This application is related to the Heggemann et al application Ser. No. 12/322,673 filed Feb. 5, 2009 (now U.S. Pat. No. 7,775,806), entitled "Electronic Housing With a Conductive Plate, and Method for Manufacturing the Same", Ser. No. 12/320,854 filed Feb. 6, 2009 (now U.S. Pat. No. 7,666,005), entitled "Housing for Electrical Components", and Ser. No. 12/322,889 filed Feb. 9, 2009 (now U.S. Pat. No. 7,736,161) entitled "Stackable Electronic Housing With Male or Female Connector Strips".

BACKGROUND OF THE INVENTION

The invention relates to a connector apparatus and a method for mounting a coding device on the connector.

More particularly, the invention relates to a plug connector. Such connectors are generally formed from two parts, one of which serves as a plug and the other of which serves as a socket for receiving the plug.

A plug connector of the general type with which the invention is related is disclosed in U.S. Pat. No. 3,491,330. A major drawback of such connectors is that the mounting and setting of the coding device on the connector are relatively burdensome.

Another plug connector is disclosed in EP 1119229 A1 wherein a coding device having two parts is attached as a pre-mounted unit on an electronic housing. After the electronic housing is applied to a base support such as a multiple terminal structure or plug-in terminal strip, one of the coding elements remains on the housing and the other is left on the base support. However, this solution is not suitable for general plug connectors because it requires movement of the housing and terminal not only in the plugging direction when they are connected together, but also in a direction perpendicular to the plugging direction, which is generally not attainable with plug connectors of the general type.

The present invention was developed in order to improve upon the known types of plug connectors by adding a coding device which is easy to install, handle, and operate, and which is relatively compact. The invention further relates to a simple method of mounting and coding the plug connector. More particularly, the coding device is connected solely by axial movement of the components without the need for any movement perpendicular to the plugging direction.

SUMMARY OF THE INVENTION

According to the invention, the coding devices for a plug type connector are configured in order to be pre-mountable as a unit on at least one of the plug connector components. The other plug connector component is configured such that when the two plug connector components are first plugged together in an axial direction, one of the two pre-mounted coding elements of the coding device becomes fixed to the other plug connector component. When the components are separated, the one coding element remains on the other connector component. This is due to the fact that the force required to separate the coding element from the other plug connector component is greater than the force required to separate the two coding elements from each other.

The term "axial" as used herein means movement of the components together or apart in a straight line without any twisting or movement of one of the plug connector components in a direction transverse to the direction of movement.

The plug connector according to the invention is advantageous with respect to installation and handling of the coding device. Moreover the connector has a very compact structure with different codes being attained not by providing a multitude of coding elements but by rotating a relatively small number of coding elements.

The plug connector is suitable for connection of electrical lines, optical waveguide lines, fluid lines or the like.

BRIEF DESCRIPTION OF THE DRAWINGS

Other objects and advantages of the invention will become apparent from a study of the following specification, when viewed in the light of the accompanying drawing, in which:

FIGS. 4*a*-4*f* are bottom, front, side, top, bottom perspective and top perspective views, respectively, of a second coding element of the first coding device according to the invention;

FIGS. 5*a*-5*c* illustrate the steps for assembling the coding elements of FIGS. 3 and 4;

FIGS. 8*a*-8*d* are top, sectional, top perspective, and bottom perspective views, respectively, of the plug component of FIG. 1 with coding elements mounted thereon;

FIGS. 12*a*-12*d* are front, side, top, and perspective views, respectively, of a first coding element of the second plug connector according to the invention;

FIGS. 13*a*-13*d* are views of a second coding element of the second plug connector according to the invention;

FIGS. 15*a* and 15*b* illustrate the socket component according to FIG. 11 with two different coding devices mounted thereon, respectively;

FIG. 15*c* illustrates the socket component according to FIG. 11 with one coding device mounted thereon and a second coding device prior to being mounted;

FIGS. 17*a*-17*d* are bottom perspective, top perspective, bottom plan, and sectional views, respectively of the plug component of FIG. 10 with coding elements mounted thereon;

DETAILED DESCRIPTION OF THE INVENTION

The plug connector according to the invention includes a first plug connector component and a corresponding second plug connector component. The connector components are preferably configured for mounting on housings, terminal strips or the like, or may be in the form of cables.

Figure 1A:
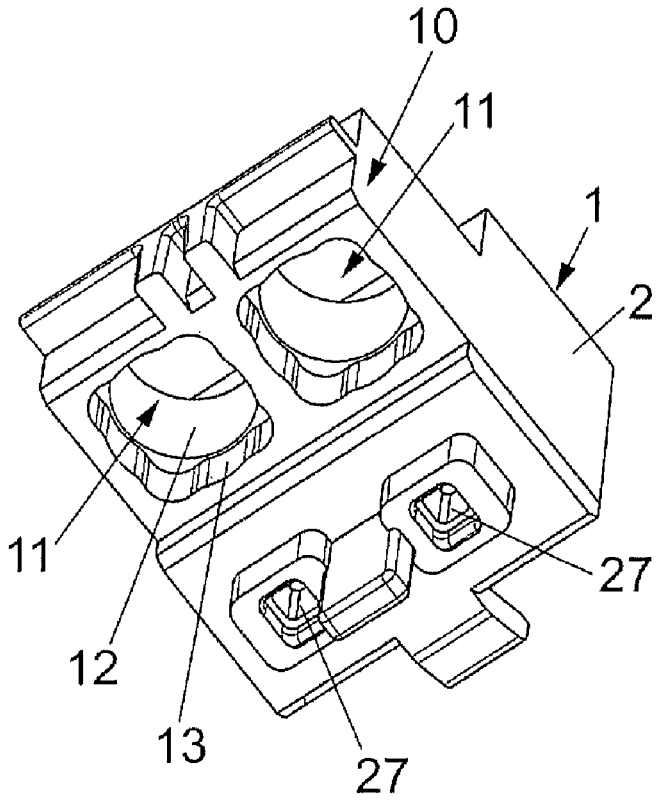
FIGS. 1*a* and 1*b* are perspective views of a plug component and a socket component, respectively, of a first plug connector according to the invention.
Figure 1B:
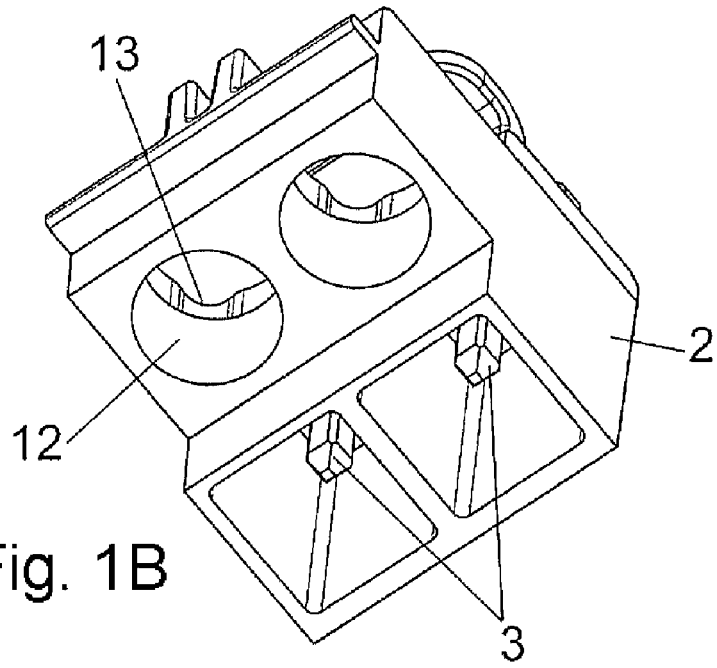

Referring first to FIGS. 1*a* and 1*b*, there is shown a plug component 1 which serves as a first plug connector component. It comprises a plug housing 2 which bears interior plug contacts 3 in the form of pins. The bottom of the housing contains openings 27 intended to receive corresponding electrical wires. This plug component may also be referred to as a "pin contact strip".

Figure 2:
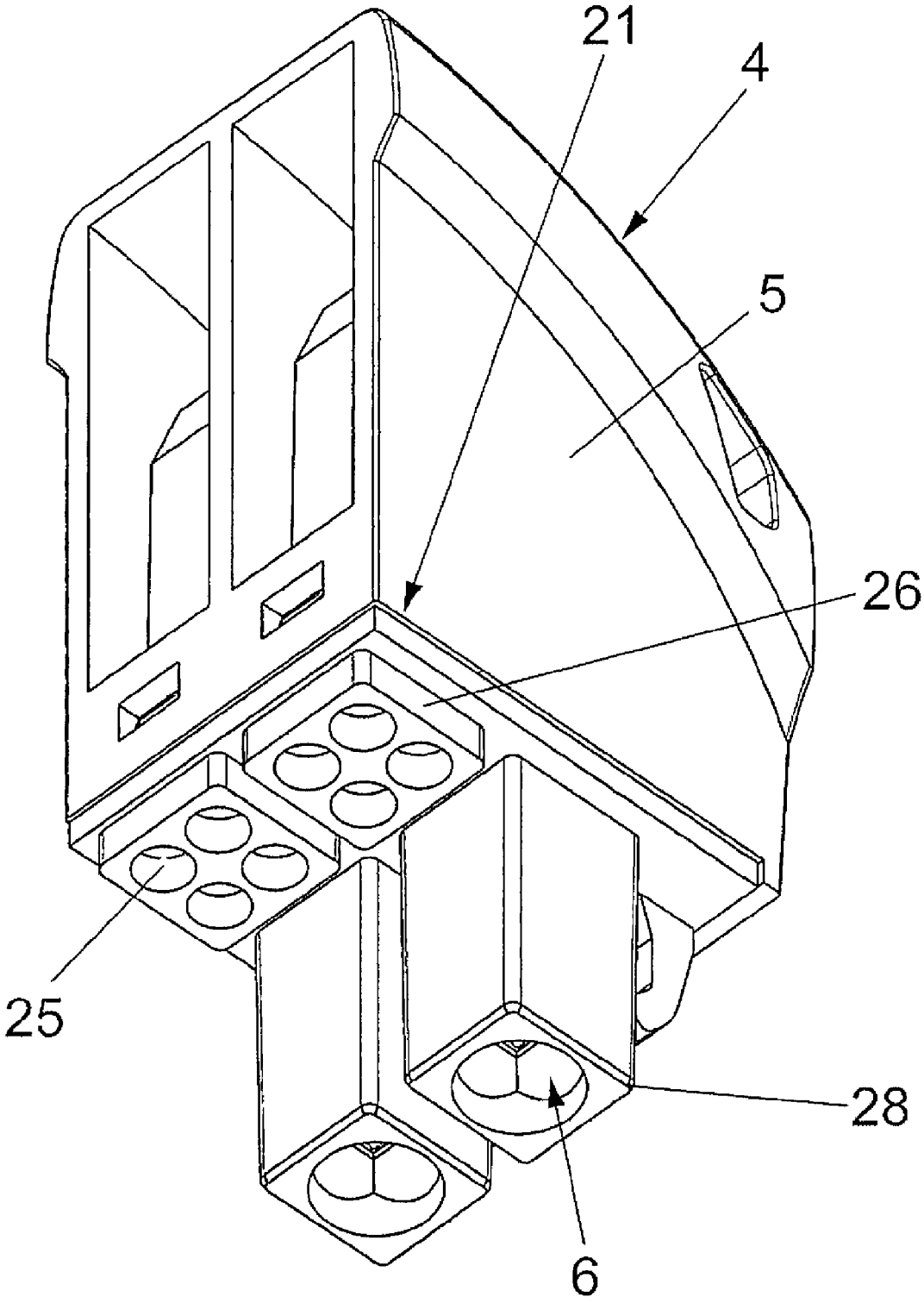
FIG. 2 is a perspective view of a socket component of the first plug connector.
Figure 3A:
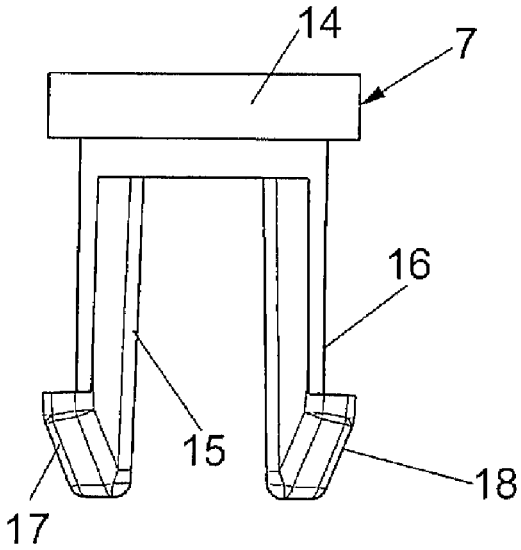
FIGS. 3*a*-3*d* are front, side, top, and perspective views, respectively of a first coding element of the first coding device according to the invention.
Figure 3B:
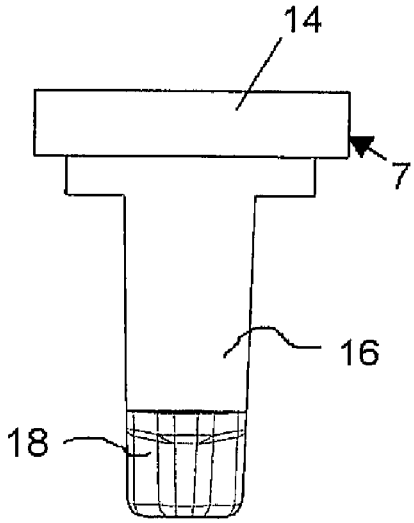
Figure 3C:
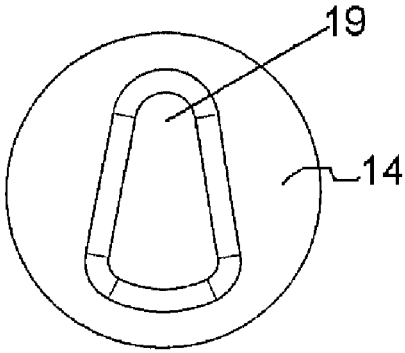
Figure 3D:
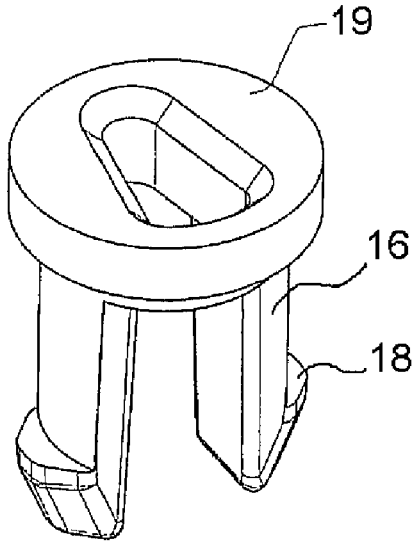

FIG. 2 illustrates a socket component 4 which serves as a second plug connector component. It comprises a socket housing 5 which contains socket contacts 6 arranged in collets 28 which retain the contacts within the housing. The housing also contains openings (not shown) intended to receive corresponding electrical wires.

The plug and socket housings 2, 5 and the corresponding electrical contacts 3, 6 form plug surfaces on their mutually facing sides. The housings are configured so that the contacts and the housings, respectively, can be plugged together as shown in FIGS. 7*b* and 16*b*, resulting in an electrical connection of the electrical contacts.

In the example shown in the drawings, the plug component 1 and the socket component 4 each have two electrical contacts. However, the invention is not limited to a particular number of contacts and it is readily understood by those skilled in the art that the connector may have one contact or may have more than two contacts.

In order to provide a mechanical coding function, the housings 2, 5 of the plug connector components are formed such that each has at least one coding element arranged thereon. In FIGS. 3*a-d*, there is shown a first coding element 7 and in FIGS. 4*a-f* is shown a second coding element 8. The coding elements are configured to be plugged together to form a coding device 9 as shown in FIGS. 5*a-c*.

A plurality of coding elements 7 may be provided for the plug connector 1. The plug connector is configured in accordance with the number of coding elements to be accommodated. According to a preferred embodiment, one coding element 7 is provided for each electrical contact on the plug connector 1. The same configurations apply for the corresponding socket.

The described plugs and sockets have two electrical contacts 3, 6 and two coding elements 7, 8 so that two corresponding coding devices 9*a*, 9*b* are formed as shown in FIGS. 6*a-c* and 7*a-c*.

To accommodate the two coding devices, the housing 2 of the plug component includes an extended portion 10 which contains openings 11 for receiving the coding elements 7*a*, 7*b* next to the plug contacts 3 as shown in FIG. 1*a*.

The openings 11 are designed such that when viewed from the plug lower surface, they have a cylindrical region 12 which transitions to a polygonal region 13. Thus, the cylindrical segment accommodates rotation of a coding element but the polygonal segment of the opening does not allow rotation of the coding element. In the example illustrated in FIG. 1*a*, the polygonal region 13 of the opening has a square configuration with lateral and corner regions which are slightly curved.

Referring to FIGS. 3*a-d*, the coding elements 7 intended to be plugged into the openings 11 each have a flanged head 14 resembling a socket with hidden contacts. Two spring-loaded legs 15, 16 depend from the head. Each of the legs includes an outwardly directed projection 17, 18 on its distal end. The projections are preferably tapered progressively toward their ends.

The spring-loaded legs 15, 16 and the projections 17, 18 are configured so that they can be pressed toward each other to a certain slight degree in the radial direction, to facilitate insertion into the cylindrical opening 11 of the plug housing 2. As the leg members are inserted farther into the opening 11, the projections 17, 18 eventually snap into the generally square region 13. That is, the legs return to their normal position and the projections interlock with the surface adjacent the opening 11 to be held within the region 13. The head 14 of the coding element rests against the housing 2. Thus, the coding elements are securely retained in the openings 11 as shown in FIG. 8-*d*. In an alternate configuration, the projections may be inwardly directed relative to the legs so that they engage contours in differently configured openings 11 (not shown).

The head 14 of the first coding element has a coding contour 19 as shown in FIG. 5*b* which is preferably configured so as to be readily rotatable with a simple tool. The coding contour 19 may be an asymmetric interior polygon, or an arrow-shaped slot as shown in FIG. 5*b*. The coding element 7 may be rotatable around its longitudinal axis in the opening 11 of the plug component with the opening region 13 being configured such that the projections 17, 18 engage two of the four corners of the region 13. Accordingly, the coding element 7 can be set in any of four positions which are readily visually distinguishable owing to the arrow-shaped contour 19.

Although the generally square configuration of the region 13 accommodates four positions of the coding element, other configurations accommodating two or three positions may be provided for the region 13 of the opening. Similarly, the number of spring-loaded legs 15, 16 and projections for the coding element may be changed as desired.

Referring now to FIG. 4, a second coding element 8 will be described. It includes a head portion 20 which is arranged on an extension portion 21 of the housing 5 of the socket as will be discussed below.

The head portion 20 preferably has a polygonal configuration and includes projections 22 extending from the upper surface. Preferably, the projections extend from opposite corner regions of the head and engage the housing extension portion 21 as shown in FIG. 7*a*.

On the side of head 20 opposite the projections 22 is a coding contour 23 of a shape corresponding to that of the coding contour 19 of the first coding element 7. More particularly, the coding contour 23 of the element 8 is a rod with an arrow-shaped cross sectional configuration which can be plugged into the accommodating contour 19 of the first coding element, preferably in a snug-fit manner to form the coding device 9 shown in FIGS. 5*a-c*. For this purpose, the coding contour 23 may have one or more ribs 29.

When the coding device 9 is initially assembled as shown in FIGS. 5*a-c*, the directions of the coding contour 19 on the plug component 1 and the coding contour 23 on the socket component 4 must be the same.

In order to ensure that the first and second coding elements 7, 8 are easily mounted in the correct orientation on the plug and socket components, respectively, the two coding elements 7, 8 of each coding device 9 are configured so that they can be assembled together in advance on one of the two plug connector components. This is illustrated in FIGS. 6*a-c* and 15*a-c*.

The first and second coding elements 7, 8 are preferably assembled at the time of fabrication to form a pre-assembled coding device 9 where the coding elements are plugged together as shown in FIGS. 5*a-c*. In this position, the coding contours 19, 23 of the elements engage each other and the head portions 14, 20 of the coding elements preferably rest against each other.

Figure 6A:
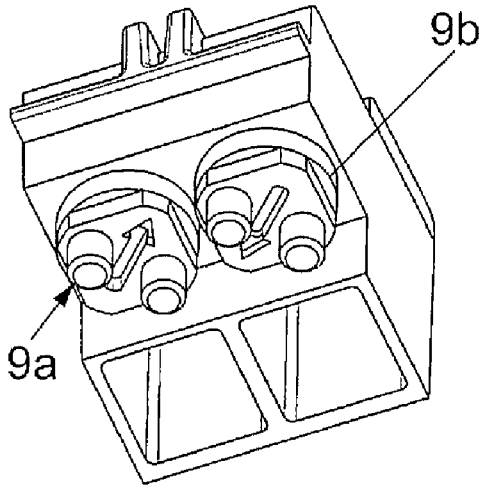
FIGS. 6*a*-6*b* illustrate the plug component according to FIG. 1 with two coding devices, respectively, disposed thereon.
Figure 6B:
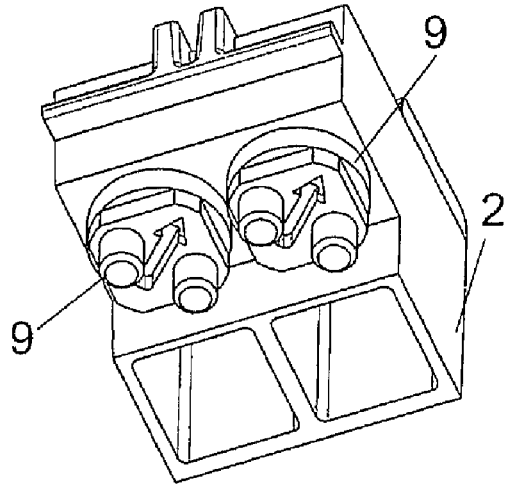
Figure 6C:
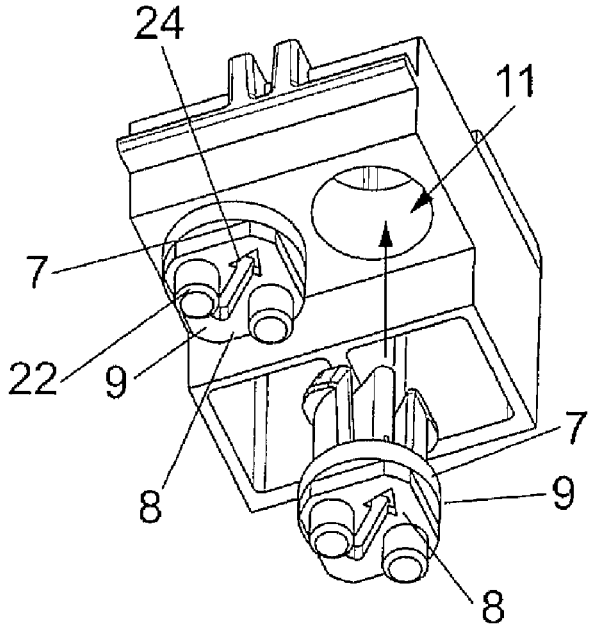
FIG. 6*c* illustrates the plug component according to FIG. 1 with one coding element mounted thereon and a second coding element prior to being mounted thereon.

With the second coding element 8 mounted on the first coding element 7, the pre-assembled coding device 9 of FIG. 5*c* can be pre-mounted on the housing 2 of the plug connector component 1 as shown in FIGS. 6*a-c*.

In order to facilitate the alignment of the coding elements, an actuating contour 24 is provided on the head 20 of the second coding element 8 opposite the side of the coding contour 23 as shown in FIG. 4*f*. The actuating contour is in the form of a slot which has an arrow-like shape so that the orientation of the arrow-shaped contour corresponds with the direction of the coding contour 23. The actuating contour 24 is used to rotate the coding device 9 in its pre-mounted position on the plug component 1.

In the pre-mounted position, the projections 22 extend from the head portion 20 of the second coding element 8. The housing 5 of the socket component 4 contains corresponding recesses 25 which are arranged so that for any orientation of the coding device, that is, for any of the possible coding positions, the projections engage the recesses 25 in a snug-fit manner. In the example shown in FIG. 2, four recesses 25 are provided, at the corners of an imaginary square, so that for each of the four possible orientations of the coding element 7 on the plug component, a corresponding pattern of recesses is provided on the socket component. This arrangement is particularly advantageous and of simple design. The recesses 25 are provided in a rectangular projection 26 which is an optional feature of the socket housing. The projection 26 has a surface against which the head 20 of the second coding element 8 abuts when the coding device is mounted on the socket.

The head 20 of the second coding element 8 may also engage in an interlocking manner a corresponding recess, preferably not rotationally symmetric, formed in the socket housing 5.

In order to install the coding devices, the plug component 1 with the coding devices 9*a* and 9*b* thereon is connected with the socket component 4 by movement in the axial direction X as shown in FIGS. 7*a* and 7*b*. In this manner, the second coding element 8 is attached to the housing 5 of the socket connector 4, so that when the two plug connector components are pulled apart in the axial direction X, the second coding element 8 will remain on the socket while the first coding element 7 will remain on the plug as shown in FIG. 7*c*.

The force required to separate the second coding element 8 from the socket must thus be greater than the force required to separate the two coding elements 7, 8 from each other. With this arrangement, the coding of the connector can be accomplished easily and rapidly.

Figure 7C:
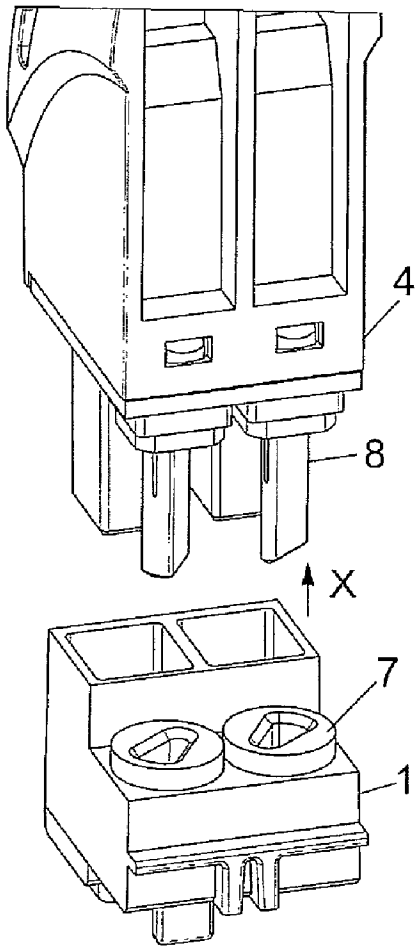
FIGS. 7*a*-7*c* illustrate the sequence of steps of initially plugging and unplugging the plug with respect to the socket of a first plug connector according to the invention, respectively, with first coding devices for the connector.
Figure 7B:
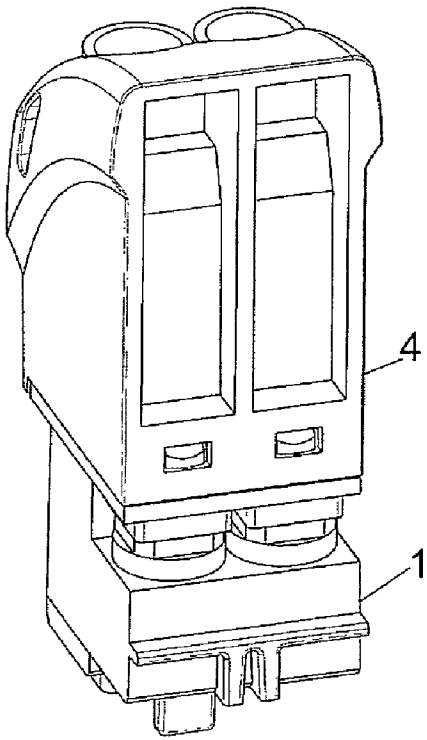
Figure 7A:
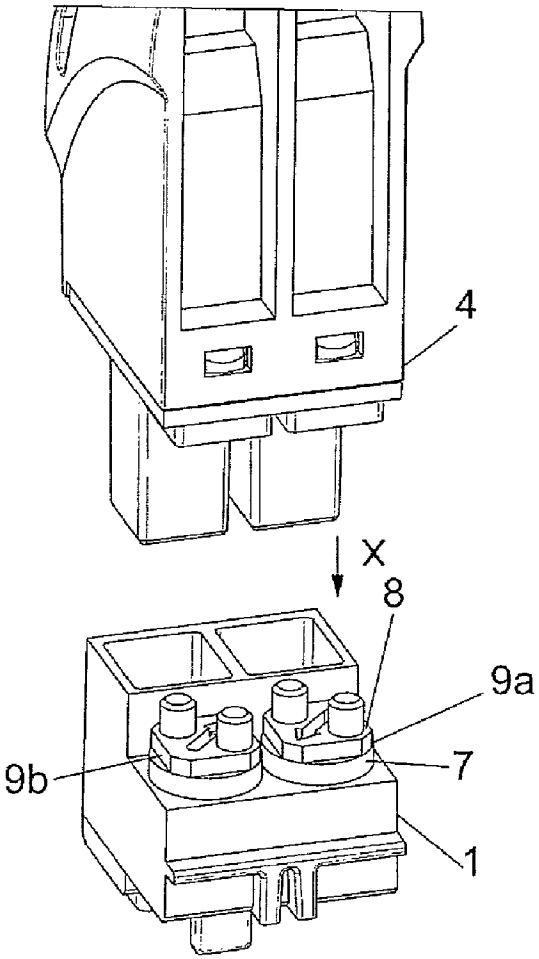
Figure 9B:
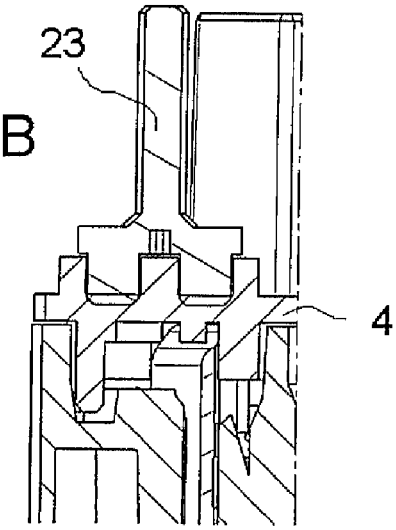
FIGS. 9*a*-9*c* are top, sectional, and top perspective views, respectively, of the socket component according to FIG. 2 with coding elements mounted thereon.
Figure 9C:
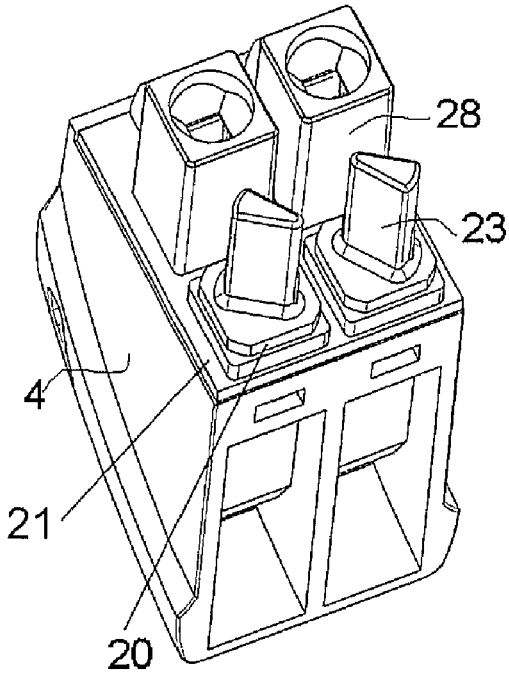
Figure 9A:
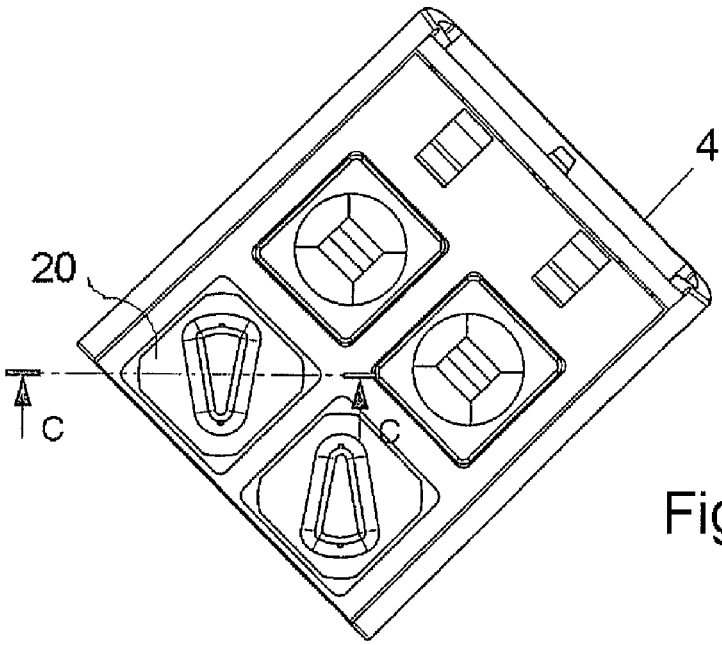

FIGS. 8*a-d* illustrate the plug component 1 with the first coding elements 7 retained in the openings 11 of the component after the plug connector components have been pulled apart as in FIG. 7*c*. FIGS. 9*a-c* illustrate the socket component 4 with the second coding elements retained in the recesses 25 of the socket after the plug connector components have been pulled apart as in FIG. 7*c*.

Using the two coding devices 9*a*, 9*b* shown in FIG. 7, sixteen codings can be obtained within a compact space. If a pin contact strip with more than two contacts is utilized, the number of codings which can be attained in a compact space can be readily increased, without making the coding system more complex.

Figure 10:
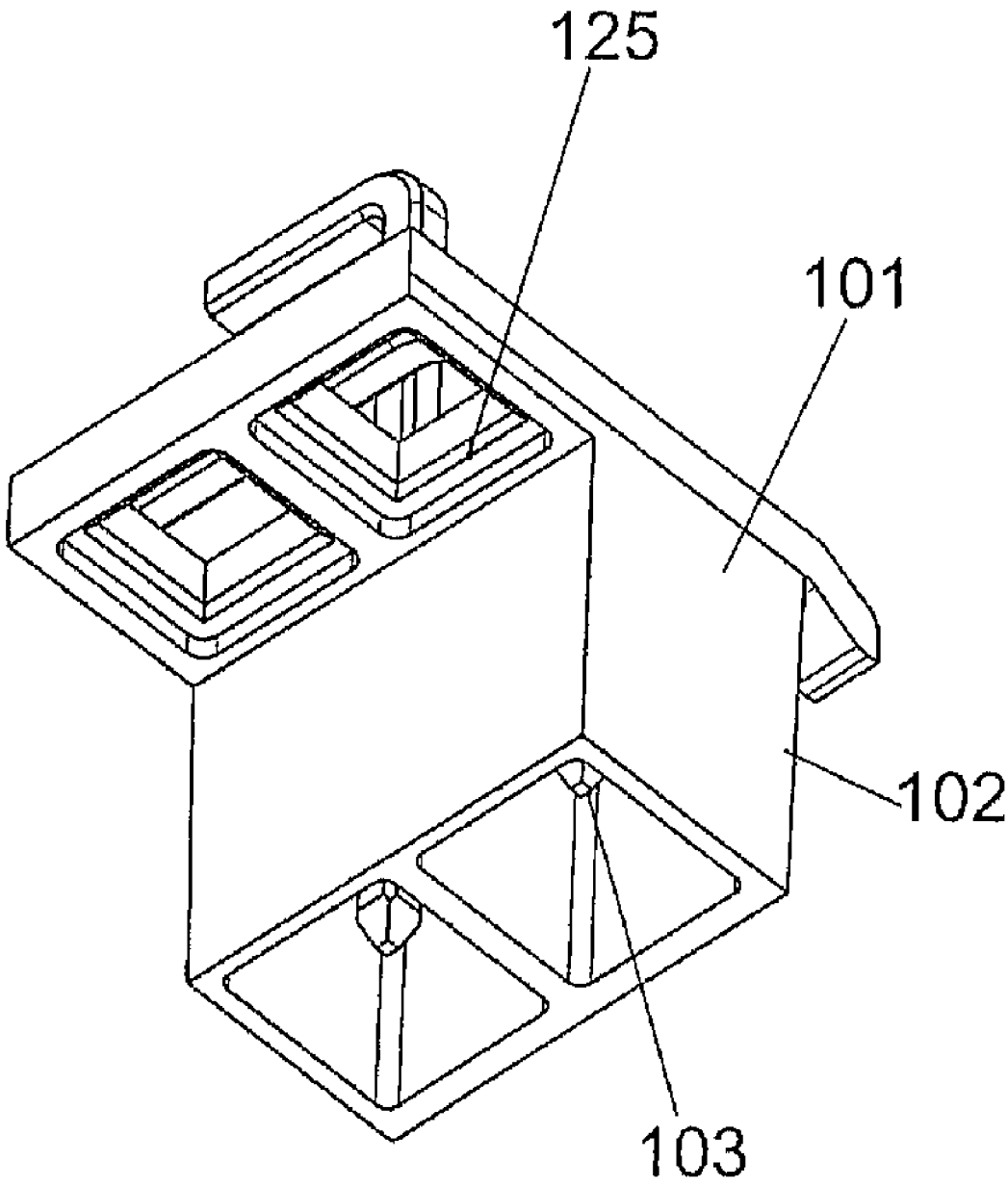
FIG. 10 is a perspective view of a plug component of a second plug connector according to the invention.

FIGS. 10-18 illustrate an alternate embodiment of the connector according to the invention, wherein each of the coding devices 109 with first and second coding elements 107, 108 is pre-mounted as a unit on the socket component 104. The plug component 101 comprises a housing 102 which contains pins 103 as shown in FIG. 10. The plug component is configured such that when it is first plugged into the socket, it picks up its coding element from the socket. In other respects, the plug and socket components have the same functions and elements as in the embodiment according to FIGS. 1-9.

Figure 11:
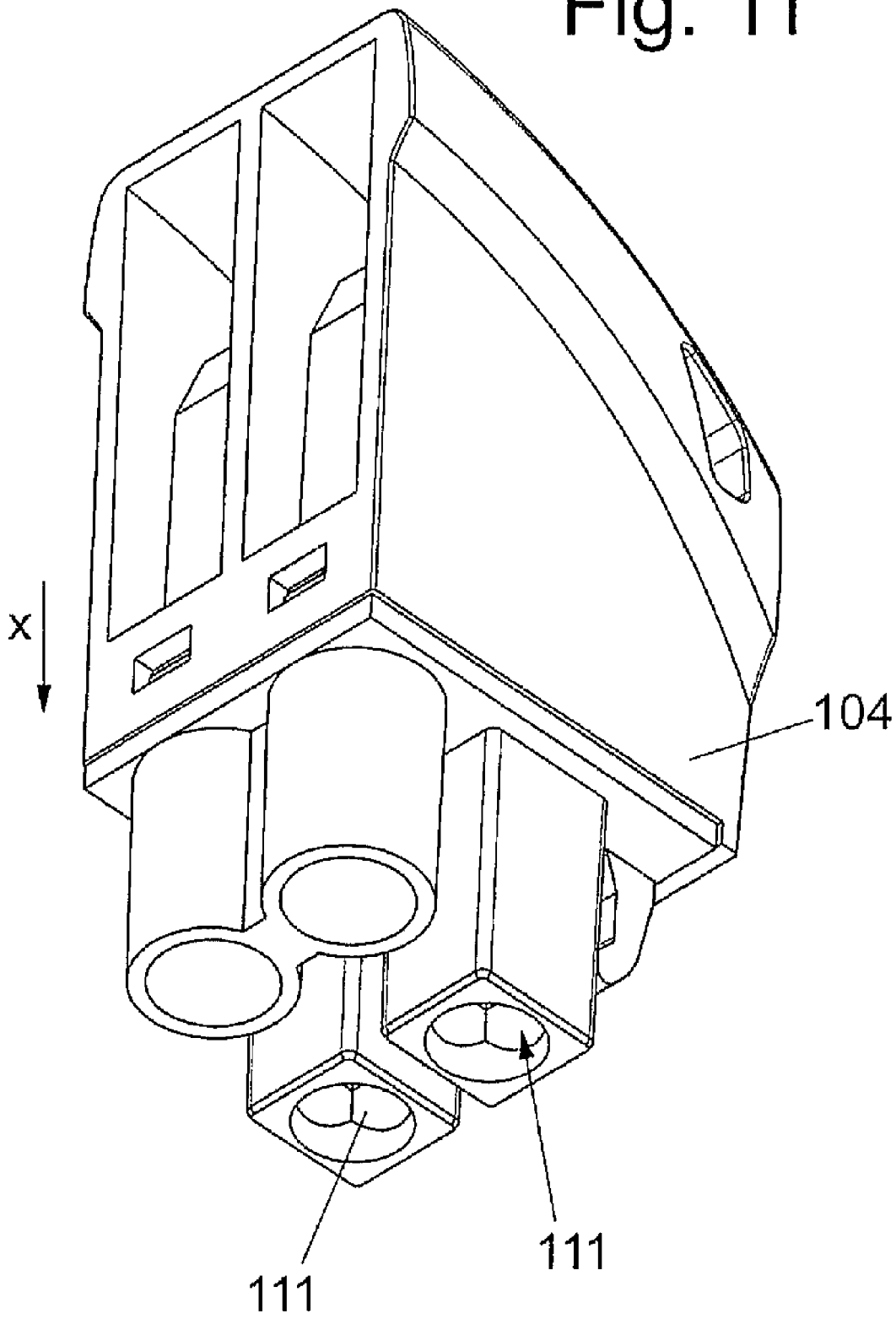
FIG. 11 is a perspective view of a socket component of a second plug connector.

More particularly, the socket 104 as shown in FIG. 11 has an accommodating contour or opening 111 into which a pre-mounted coding device 109 can be inserted such as by plugging. A first coding element 107 similar to the coding element 7 is inserted into the opening 111 which has differently configured regions 112 and 113 and can be locked in various positions by catch devices. As shown in FIGS. 12*a-d*, the first coding element includes a hollow cylindrical portion 130 which depends from the head portion 114 of the coding element. Spring loaded leg members 115, 116 having projections 117, 118 are provided beyond the cylindrical portion 120. The opening 111 in the socket 104 is axially longer than the opening 11 shown in the embodiment of FIGS. 1-9 and as a result, the configuration of the spring-loaded leg members 115, 116 with projections 117, 118 is different than in FIGS. 1-9. The leg members are shorter because they are formed at the end of the hollow cylindrical member 130 as shown in FIGS. 12*a-d*. The head portion of the first coding element 107 contains a coding contour 119.

In FIGS. 13*a-d*, a second coding element 108 is shown which is similar to the coding element 8 of FIGS. 1-9. It includes a head portion 120 having at least one projection 122, a lower contour 123 and an actuating contour 124. However, after pre-mounting with the first coding element 107 on the socket 104, the second coding element 108 is picked up by the plug 101 when the plug is initially plugged into the socket 104 as shown in FIG. 16*c*.

The head 120 of the second coding element 108 has a stepped configuration owing to the projection 122 and has tapered edges. The head is at least partially inserted into a corresponding opening 125 in the plug component 101 as shown in FIG. 10. The opening 125 is designed to retain the projection of the coding element so that the head of the coding element can be locked into any of four positions in the opening 125.

Figure 14A:
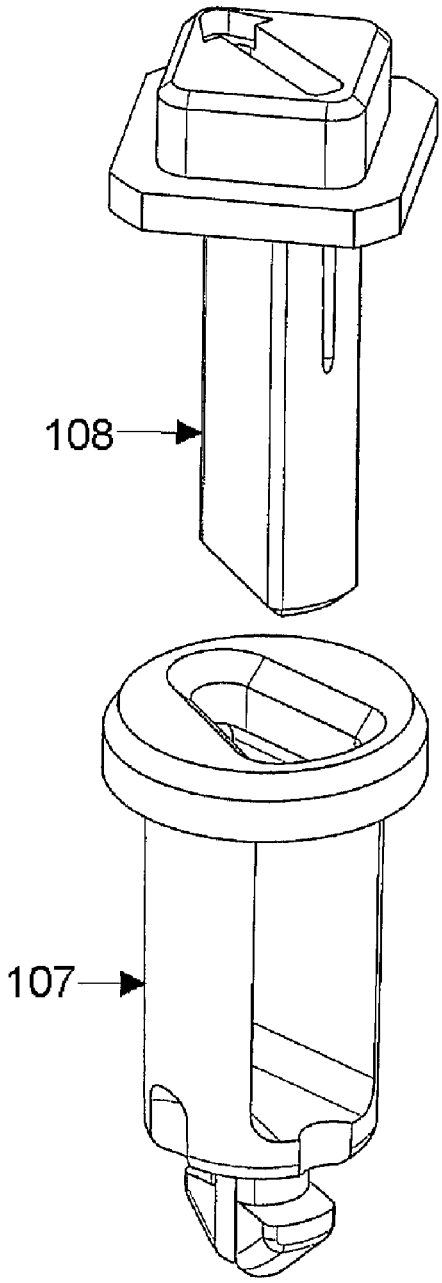
FIGS. 14*a* and 14*b* illustrate the steps for assembling the coding elements of FIGS. 12 and 13.
Figure 14B:
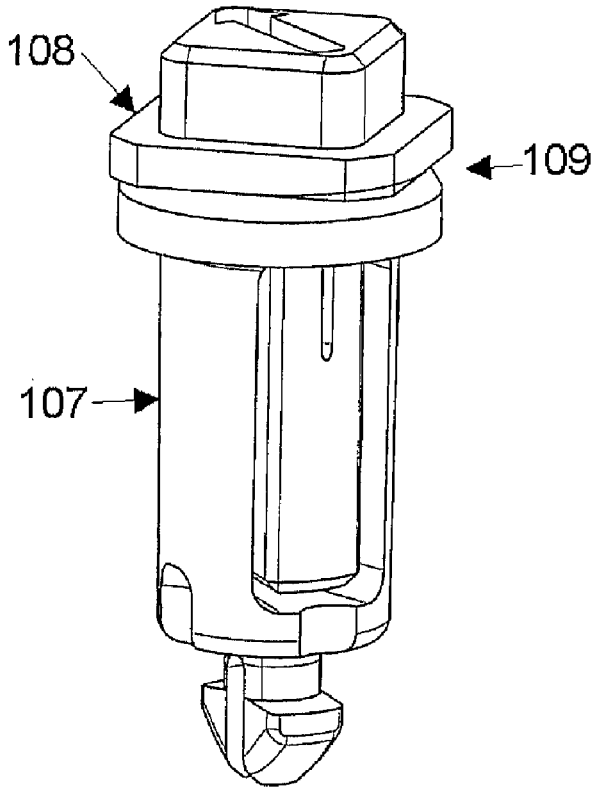

FIG. 14*a* shows the assembly of the first coding element 107 and the second coding element 108 to form the pre-assembled coding device 109 of FIG. 14*b*.

FIGS. 15*a* and 15*b* show a socket 104 having two coding devices 109*a* and 109*b* mounted thereon, with the coding device 109*b* having a different orientation in FIG. 15*b*. FIG. 15*c* shows a socket 104 having the coding device 109*a* mounted thereon and the coding device 109*b* prior to mounting.

Figure 16A:
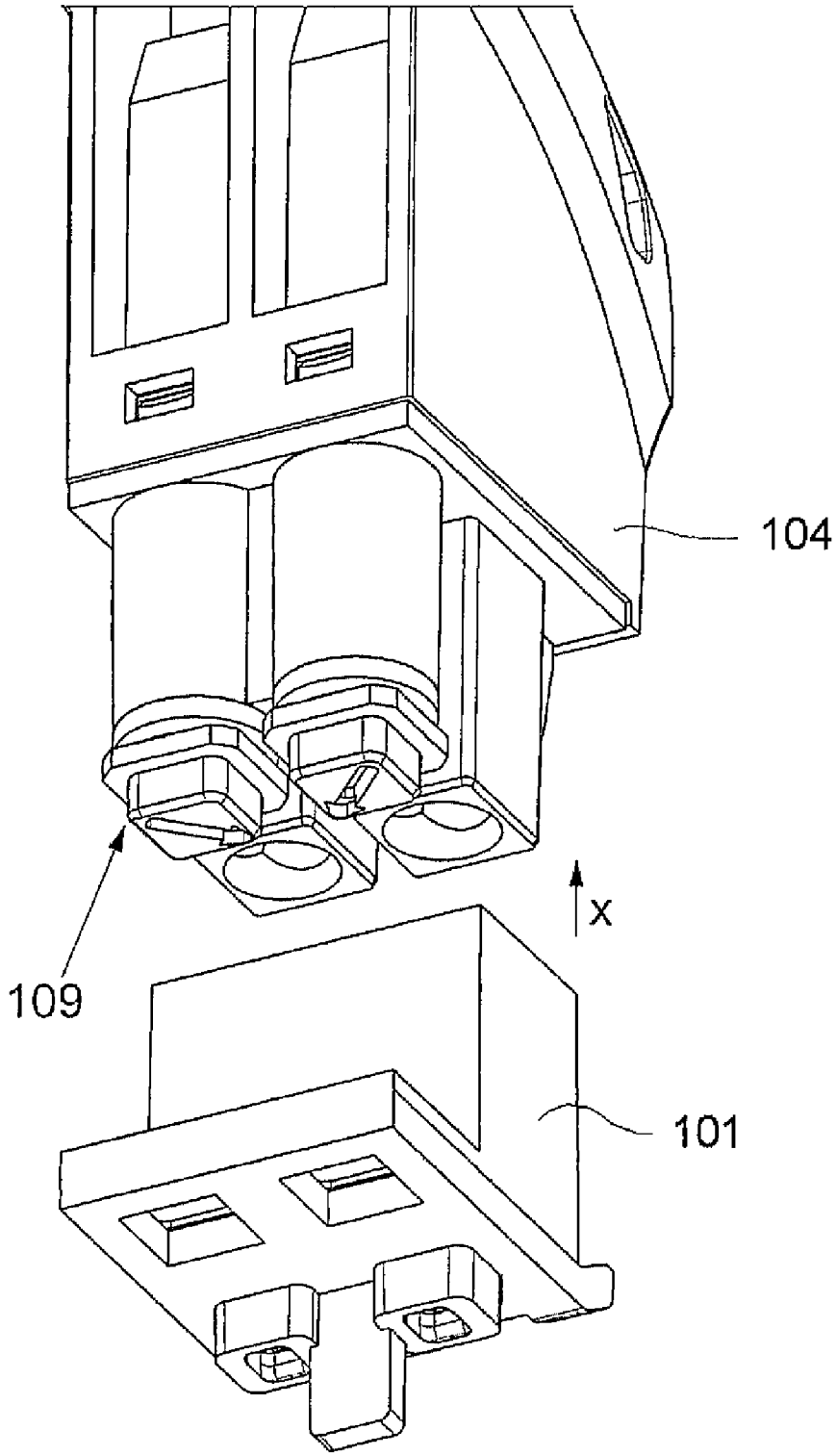
FIGS. 16*a*-16*c* illustrate the sequence of steps of initially plugging and unplugging of the plug component with respect to the socket component of the second connector according to the invention including the coding devices of FIG. 14.
Figure 16B:
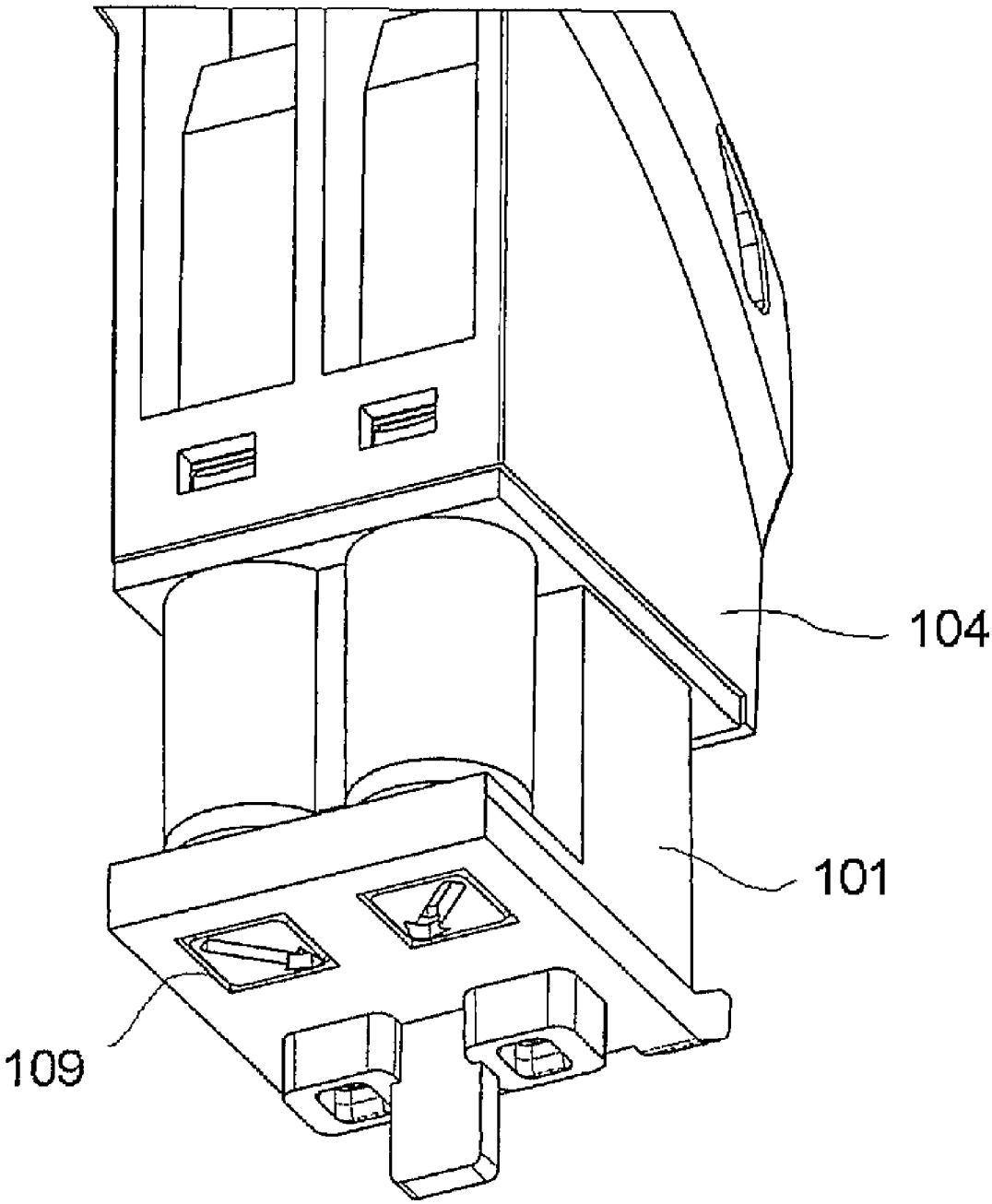
Figure 16C:
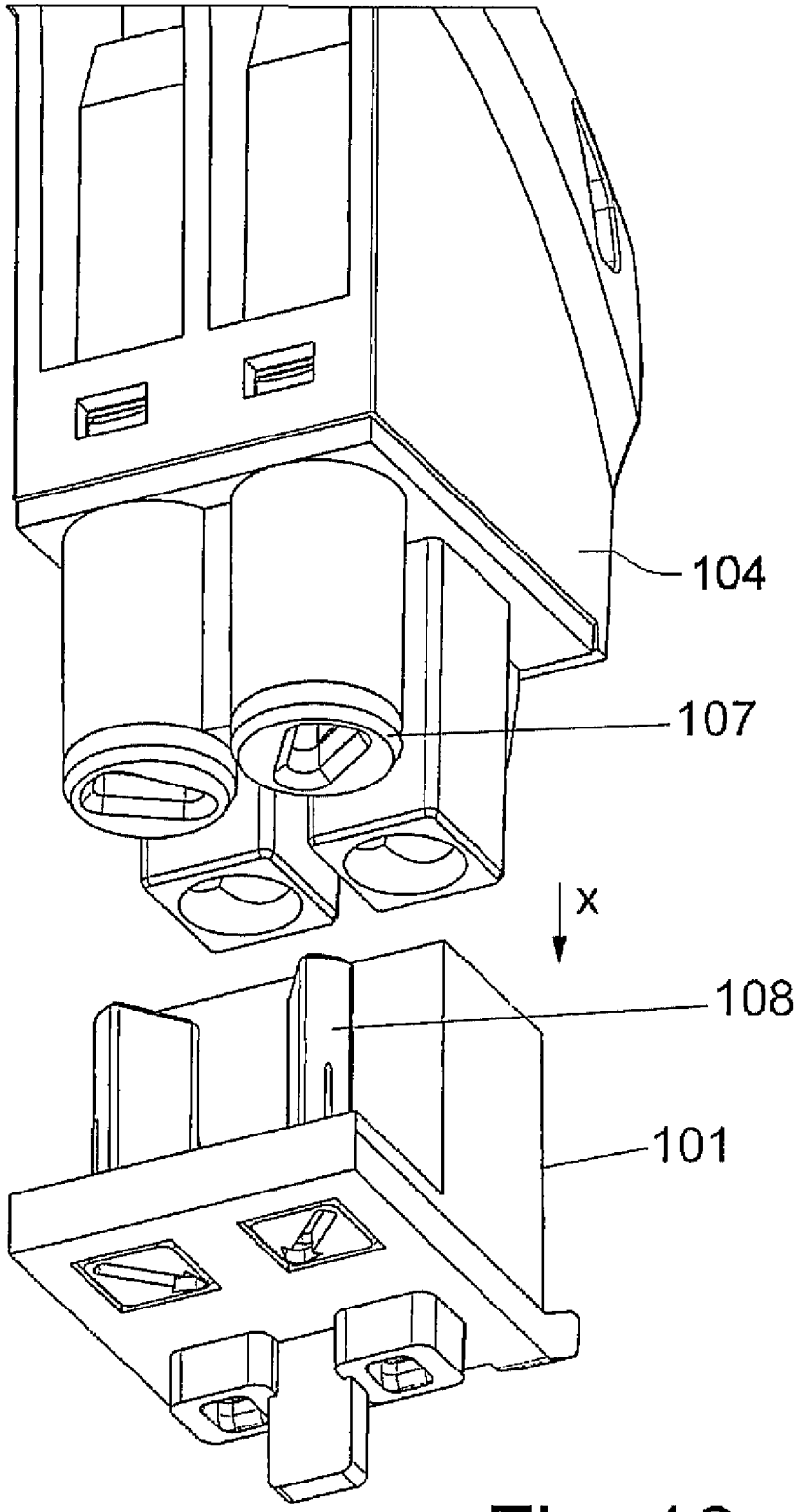
Figure 17D:
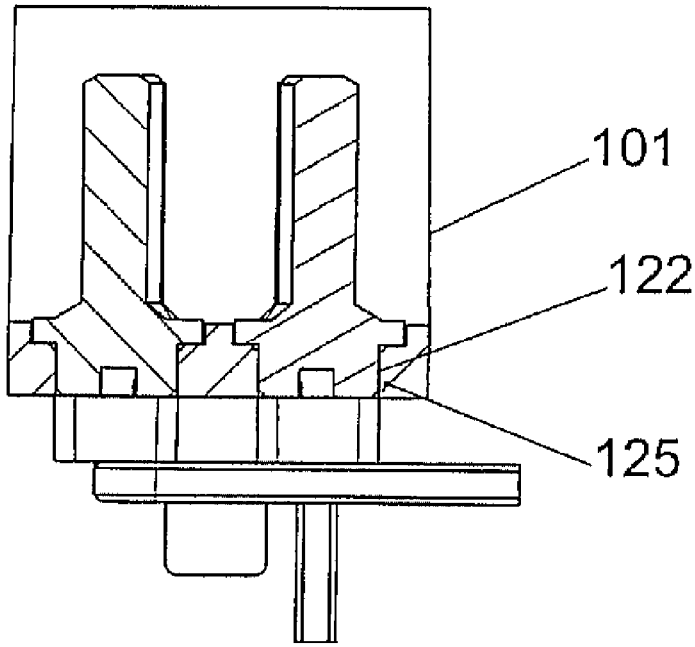
Figure 17C:
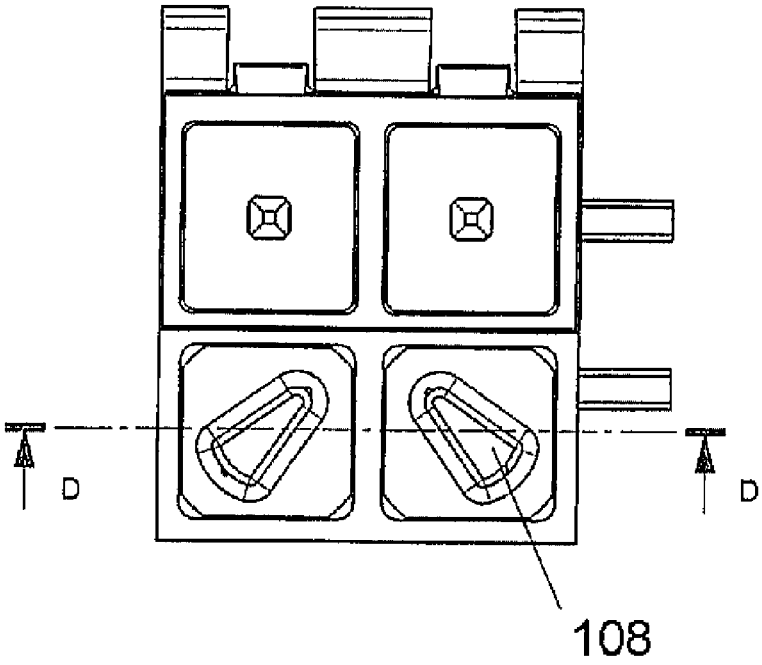
Figure 18B:
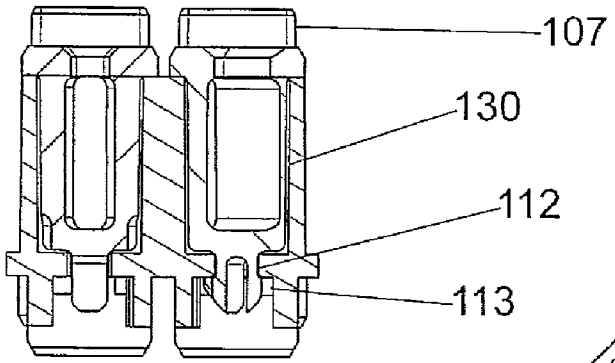
FIG. 18*b* is a sectional view of the socket component of FIG. 18*a* taken along line B-B.
Figure 18D:
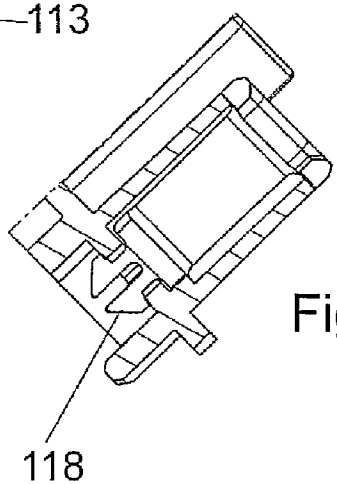
FIG. 18*d* is a sectional view of the socket component of FIG. 18*a* taken along line D-D.
Figure 18A:
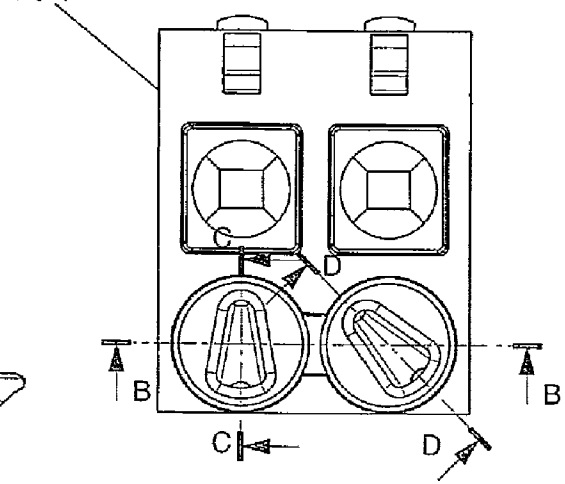
FIG. 18*a* is a bottom view of the socket component of FIG. 11 with coding elements mounted thereon.
Figure 18C:
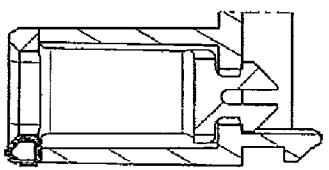
FIG. 18*c* is a sectional view of the socket component of FIG. 18*a* taken along line C-C.

In FIG. 16*a*, a socket 104 having coding devices 109 mounted thereon is shown prior to connection with the plug component 101. FIG. 16*b* shows the socket and plug components connected together in the axial direction X, with the coding devices 109 arranged in openings 111 in the plug component. FIG. 16*c* shows the socket and plug components separated in the direction X, with the first coding elements retained by the socket 104 and the second coding elements retained by the plug 101. FIGS. 17*a-d* are a bottom perspective view, a top perspective view, a bottom plan view, and a section along line D-D of FIG. 17*c*, respectively, of the plug component 101 with the second coding elements 108 retained therein following separation of the components. FIG. 17*d* shows the arrangement of the projection 122 within the opening 125. FIG. 18*a* is a bottom plan view of the socket with the first coding elements 107 retained therein following separation of the components. FIGS. 18*b-d* are sectional views taken along lines B-B, C-C, and D-D, respectively, of FIG. 18*a*.

While the preferred forms and embodiments of the invention have been illustrated and described, it will be apparent to those skilled in the art that changes may be made without deviating from the invention described above.

What is claimed is:

1. An electrical connector, comprising:

(a) first and second connector components in the form of a plug and a socket, said connector components each having a housing containing at least one opening in which is mounted an electrical contact, said electrical contacts being arranged on said components for connection when said components are axially connected; and (b) a coding device having first and second coding elements, said first coding element being adapted for connection with said first connector component and said second coding element being adapted for connection with said second connector component, said first coding element including a head portion, and spring-loaded legs depending from said head portion, each of said legs having a projection at a distal end for engaging said housing within said opening with a snap-fit connection, and means for retaining said first coding element in a selected rotational position with respect to said housing;

(c) said first and second coding elements being pre-assembled as a unit on said first connector component;

(d) said second connector component being configured so that when said first and second connector components are initially connected in an axial direction, said second coding element is connected with said second connector component and when said connector components are axially separated, said first coding element remains connected with said first connector component.

2. A plug connector as defined in claim 1, wherein said first coding element head portion contains a coding contour.

3. A plug connector as defined in claim 2, wherein said second coding element includes a head portion containing a corresponding coding contour.

4. A plug connector as defined in claim 3, wherein said coding contour of said second coding element comprises a rod depending from said head portion, said rod having an arrow-shaped cross-sectional configuration which can be plugged into said coding contour of said first coding element for a snug-fit connection.

5. A plug connector as defined in claim 3, wherein said head portion of said second coding element has a disc configuration and includes at least one projection on a top surface thereof for insertion into recesses in said socket housing.

6. A plug connector as defined in claim 3, wherein said socket housing contains four recesses arranged at the corners of an imaginary square so that for each of four possible orientations of said first coding element on said plug housing, a corresponding configuration of recesses is provided on said socket housing.

7. A plug connector as defined in claim 3, wherein said head portion includes a contoured projection which engages a corresponding opening in said plug housing.

8. A plug connector as defined in claim 4, wherein said rod includes at least one rib.

9. A plug connector as defined in claim 4, wherein said second coding element includes an actuating contour on said head portion opposite said rod.

10. A plug connector as defined in claim 9, wherein said actuating contour comprises a slot configured in the shape of an arrow.

11. A plug connector as defined in claim 10, wherein said slot is oriented in the same direction as said rod.

12. A plug connector as defined in claim 1, wherein said first connector component comprises a plug said second connector component comprises a socket, said coding device being pre-mountable on said plug.

13. A plug connector as defined in claim 1, wherein said first connector component comprises a plug and said second connector component comprises a socket, said coding device being pre-mountable on said socket.

14. A plug connector as defined in claim 1, wherein said openings have a cylindrical portion adjacent to a surface of said housing and a polygonal portion within said housing.

15. A plug connector as defined in claim 14, wherein said polygonal portion has a generally rectangular configuration.

16. A method for coding a plug connector, comprising the steps of (a) pre-mounting a coding device comprising first and second coding elements on one of a pair of plug connector components, said first coding element including a head portion, and spring-loaded leg portions depending from said head portion for locking said first coding element in one of a plurality of longitudinal rotational positions relative to the associated connector component;

(b) connecting said plug connector components in an axial direction; and (c) separating said plug connector components in an axial direction, one of said coding elements remaining connected with one of said plug connector components and the other of said coding elements remaining connected with the other of said plug connector components.

* * * * *